United States Patent [19]

Scanlan

[11] Patent Number: 4,478,025

[45] Date of Patent: Oct. 23, 1984

[54] VACUUM PACKING DEVICE

[76] Inventor: Gregory P. Scanlan, 821 Pine St., San Francisco, Calif. 94108

[21] Appl. No.: 297,860

[22] Filed: Aug. 31, 1981

[51] Int. Cl.[3] ..... B65B 31/00

[52] U.S. Cl. ..... 53/512; 53/434; 53/86; 53/390

[58] Field of Search ..... 53/434, 86, 512, 405, 53/408, 390, 427, 481

[56] References Cited

U.S. PATENT DOCUMENTS

| | | | |
|---|---|---|---|
| 3,832,824 | 9/1974 | Burrell | 53/512 X |
| 3,867,226 | 2/1975 | Guido et al. | 53/479 X |
| 4,057,949 | 11/1977 | Greffe | 53/434 |
| 4,164,111 | 8/1979 | Di Bernardo | 53/512 |

FOREIGN PATENT DOCUMENTS

| | | | |
|---|---|---|---|
| 1390023 | 4/1975 | United Kingdom | 53/512 |

*Primary Examiner*—Nicholas P. Godici

*Assistant Examiner*—P. Weston Musselman, Jr.

*Attorney, Agent, or Firm*—Flehr, Hohbach, Test, Albritton & Herbert

[57] ABSTRACT

A method and means for vacuum sealing perishable materials in bags fabricated of vacuum gas impermeable material. A method according to the present invention includes: partially filling a bag fabricated of gas impermeable material with perishable product, loosely positioning clamping means about the open end of said bag, isolating the loosely clamped bag in a sealed treatment zone, drawing a vacuum in the treatment zone to evacuate the interior of said loosely clamped bag, maintaining the vacuum for a period of time to equalize vacuum pressure within the treatment zone and the loosely clamped bag, rapidly breaking the vacuum to expel remaining gases from the bag and to compress the clamping means to seal the bag, separately sealing the clamped-end of the bag and removing the clamping means to obtain a vacuum packed product.

1 Claim, 7 Drawing Figures

VACUUM PACKING DEVICE

BACKGROUND OF THE INVENTION

The present invention relates to a device and method for vacuum packing materials in vacuum tight bags, such as plastic bags, and more particularly to a device and method of vacuum packaging suitable for use in the home.

Vacuum packaging is a recognized technique for storing and preserving food. The canning of food results in a vacuum seal, and many retail food items are packaged under vacuum. Vacuum storage is advantageous when freezing food because it eliminates freezer burn. The removal of air surrounding food results in longer shelf life and more flavorful and eye appealing food. Although many foods are sold in vacuum package containers, once the containers are opened and the vacuum lost, repackaging food under vacuum is seldom considered practical. Consequently the benefits of vacuum packaging have been available only until the package is first opened, but after which the food must be used relatively quickly.

Vacuum packaging has not been employed in the home because no convenient and quick means for accomplishing vacuum packing has been heretofore available. Home canning which provides a vacuum seal, is time consuming and generally may not be used to repackage foods sold originally in vacuum containers. Devices for evacuating and sealing bags have heretofore been inconvenient, as for example in Waldrop et al., U.S. Pat. No. 3,851,437, which discloses a receptacle evacuating apparatus and method wherein a food-filled bag is evacuated within a vacuum chamber, clamped onto a vacuum nozzle, and removed while still in communication with a source of vacuum through such nozzle, to a separate heat sealing closing device. However, the retention of the vacuum prior to heat sealing must be performed while the nozzle is attached to a separately provided vacuum resevoir unit. Therefore, the system and apparatus shown by Waldrop et al. appears to be complicated and to require expensive apparatus which is not suitable for convenient home use. Another approach to home vacuum packing of bags is found in Hawkins, U.S. Pat. No. 3,965,646, wherein bags are evacuated and clamped and clipped while the bag remains in communication with a vacuum source. A disadvantage of the process shown in the Hawkins patent is that two separate evacuating steps are required. Moreover, the clamping and clipping device disclosed by Hawkins appears to be complicated and also appears likely to be rather expensive for employment in home use.

SUMMARY OF THE INVENTION AND OBJECTS

It is an object of the present invention to provide a method and means convenient for home use for vacuum sealing vacuum-tight bags, such as plastic bags.

It is a further object of the present invention to provide reusable clamping means convenient for home use in vacuum sealing vacuum-tight bags such as plastic bags.

The invention provides a method and means for packaging vacuum packed food products into bags or other flexible containers constructed of gas impermeable material. According to the method of the present invention, perishable food material is placed into a bag constructed of gas impermeable material. A clamping means is loosely placed about the open or filling end of the bag and the resulting loosely clamped bag is isolated in a sealed treatment zone. A vacuum is drawn within said treatment zone to evacuate the interior of said loosely clamped bag and said vacuum is maintained for a period of time to equalize the vacuum pressure within the treatment zone and within the interior of said loosely clamped bag. The vacuum within said treatment zone is then rapidly broken by exposing to the surrounding atmosphere, thereby expelling the remaining gases from within the interior of said bag and also compressing said clamping means tightly on the filling end of said bag to seal said bag. The sealed bag may then be removed from the treatment zone and separately sealed prior to removing the clamping means from the closed filling end of the bag, thereby resulting in a vacuum packed food product.

Accordingly, the invention provides a device for rapidly sealing vacuum-tight bags whereby such a device comprises a clamp means comprising a plurality of opposable, elongated prongs at least two of which are adjoined together at one end by hinge means. Each said elongated prong may define a cavity having an opening facing an opposing prong when said clamp is in a closed position. According to the instant invention said clamp means is provided with deformable strip material upon opposable surfaces thereof. At the unhinged end of one of said prongs a locking member is attached to securely interlock with the unhinged end of an opposing prong, thereby holding said clamp means in a closed position. Said clamp means is thus adapted to loosely clamp the opened, flattened end of a bag fabricated of vacuum-tight material so that when the bag and attached clamp means are placed in a vacuum, air is evacuated from the bag through said loosely clamped open end and when said vacuum is thereafter released, additional air is expelled from the interior of the bag while pressure on the outer surface thereof affects sealing of said bag, thereby retaining a vacuum within said bag.

BRIEF DESCRIPTION OF THE DRAWINGS

The preferred embodiment of the invention is described in the accompanying drawings with reference to the following, in which:

Referring to FIG. 1, there is shown a general flow sheet of the method of carrying out the vacuum packing process according to the present invention, and which particularly illustrates the main steps in sequence.

Figure 1:
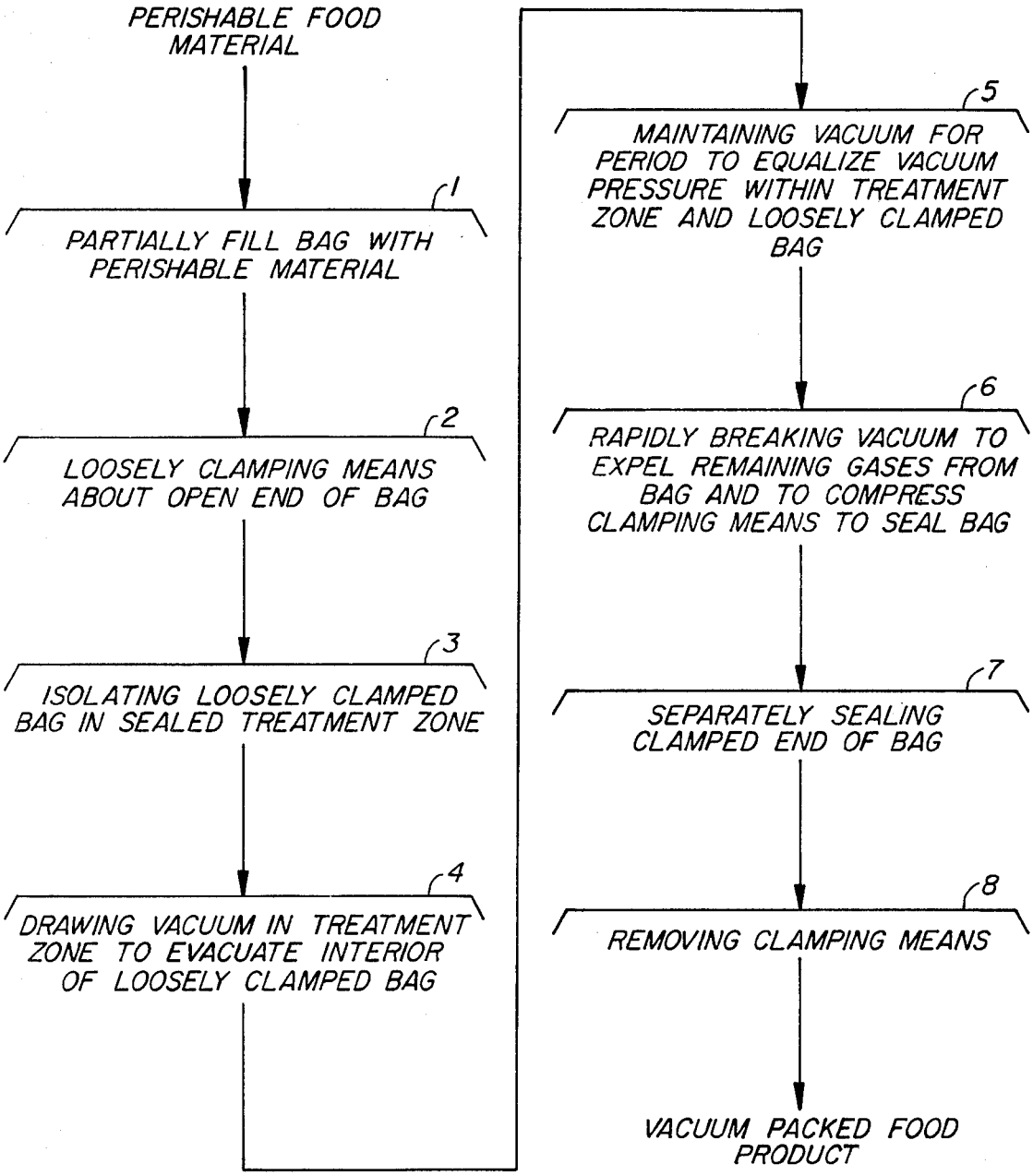
FIG. 1 is a flow sheet illustrating the general method of carrying out the vacuum packing process according to the instant invention.

In Step 1, perishable food material is initially placed into a bag or other deformable container constructed of gas impermeable material. The bag or the container may be substantially filled provided that there is a sufficient surface area remaining at the open or filling end of said bag to accommodate clamping means. Since the bag is to contain food material preferably, both the interior and exterior of said bag should be clean and relatively sterile.

In Step 2, a clamping means is loosely placed exteriorly adjacent the open end of the bag. Said clamping means should apply enough pressure on the exterior surface of the bag to close the opening thereof and to retain the contents therein, however, the pressure should not be so great as to prevent the escape of air from within the bag when said bag is exposed to a vacuum. The preferred clamping means to accomplish this purpose is more particularly described below in connection with FIGS. 2*a*, 2*b*, 3*a*, 3*b* and 3*c*.

In Step 3, the loosely clamped bag is isolated in a sealed treatment zone. It is a particuar advantage of the present invention that the bag and clamping means do not require any further attachments or adapters in order to accomplish evacuation of the bag.

Therefore, the bag and clamping means may be placed within any sealed zone, particularly a sealed chamber, the interior of which may be evacuated by a evacuating means, such as a vacuum pump. A preferred system of apparatus to provide sealed treatment zone is described below in conjunction with FIG. 4.

In Step 4, a vacuum is drawn in the sealed treatment zone to evacuate the interior of the loosely clamped bag within the treatment zone to evacuate the interstices of the perishable food material. The vacuum may be drawn from within this zone by means of a conventional vacuum pump, preferably as described below in conjunction with FIG. 4.

In Step 5, the vacuum condition within the treatment zone is maintained for a period of time sufficient to equalize the vacuum pressure within the treatment zone and within the loosely clamped bag. Since the pressure within the bag and within said treatment zone remains substantially equal throughout the evacuation process, the pressure of the clamp upon the outer surface of the bag may remain substantially constant, thereby allowing air from the interior of the bag to be withdrawn to create a vacuum within the bag equal to the vacuum within the treatment zone.

In Step 6, the vacuum within the sealed treatment zone is rapidly broken, thereby exposing the zone to the atmospheric pressure of the surrounding air. The sudden onrush of air into the interior of the treatment zone immediately produces exterior pressure on the outer surface of the bag thereby compressing the bag and expelling the remaining air from the interior of the bag to create a higher degree of vacuum within the bag than originally obtained with the vacuum pump. The sudden onrush of atmospheric air also exerts pressure on the outwardly facing surfaces of the clamp means, thereby causing the clamp means to compress the end of the bag to seal the same. Since the clamp means is equipped to contact the bag with a deformable strip material, the pressure from the surrounding atmosphere initially instantaneously compresses the clamp means to deform the strip material but does not exert sufficient pressure on the bag to seal the bag from the flow of air from within. Therefore, the remaining air is instantaneously expelled from the interior of the bag prior, with sufficient pressure also being exerted on the clamp means to almost simultaneously seal the bag. Therefore, a particular advantage of the present invention is that upon rapidly breaking the vacuum of the sealed treatment zone, the remaining air within the bag is expelled and the bag is sealed without requirement for any additional devices or attachments for such purpose.

In Step 7, the clamped end of the bag is separately sealed by conventional means known in the art, for example, by heat sealing. Depending on the texture, thickness and cohesive properties of the gas impermeable material of which the bag is constructed, in some instances the compression caused by the clamping means on the open-end of the bag will permit the bag to be self-sealed. In such instances, Steps 6 and 7 are accomplished in one step, merely by breaking the vacuum within the sealed treatment zone.

In Step 8, the clamping means is removed from the bag, thereby producing a vacuum packed food product. The vacuum within the bag is retained either by conventional sealing means as described above, such as heat sealing, or alternatively, the bag may be self-sealing whereby the bag remains sealed by virtue of the inherent cohesive properties of the bag material, the existence of the vacuum within the bag and the external pressure of atmospheric air.

Figure 2A:
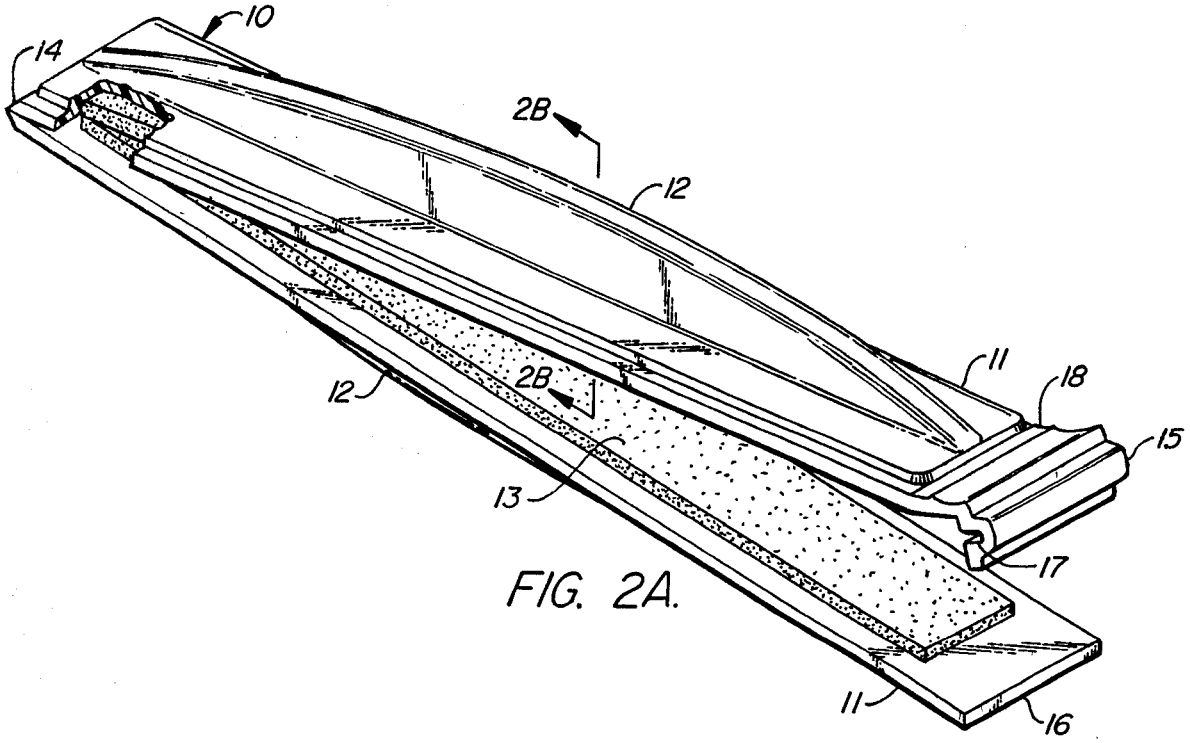
FIG. 2*a* is a partial cutaway perspective of the preferred clamp according to the instant invention.

Referring to FIG. 2*a* there is shown preferred clamp means 10 comprising two elongated flat prongs 11. Each of the prongs define elongated inverted cavity defining projections 12 which form part of the prongs 11. The openings of the bag and each opening of each cavity are completely sealed by a deformable sealing member 13. The prongs 11 are adjoined at one end by hinge means 14 and, at one end of one of the prongs, a locking member 15 is provided which is hinged and adapted to securely interlock with the unhinged end of the other prong 16 by fitting into groove 17. Locking member 15 is hinged at locus 18 so that the locking member 15 is readily adapted to pivot between locked and unlocked positions. Hinge locations 14 and 18 may be formed by altering (decreasing) the thickness of clamp 10 at those locations, say, where the clamp is formed of rigid plastic or similar material. Clamp means 10 may be fabricated of rigid plastic or metal. Deformable sealing members 13 may be fabricated of polyurethane foam or other rubber-like material which is deformable when pressure is exerted thereon, but returns to its original form when pressure is released.

Figure 2B:
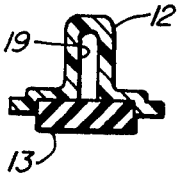
FIG. 2*b* is a cross section of the clamp according to the instant invention taken through line 2*b* of FIG. 2*a*.

Referring to FIG. 2*b*, there is shown a projection 12 which defines cavity 19. Forming a part of the prongs 11, on each side, is a porous deformable sealing member 13 which completely encloses the opening of the cavity 19.

Figure 3A:
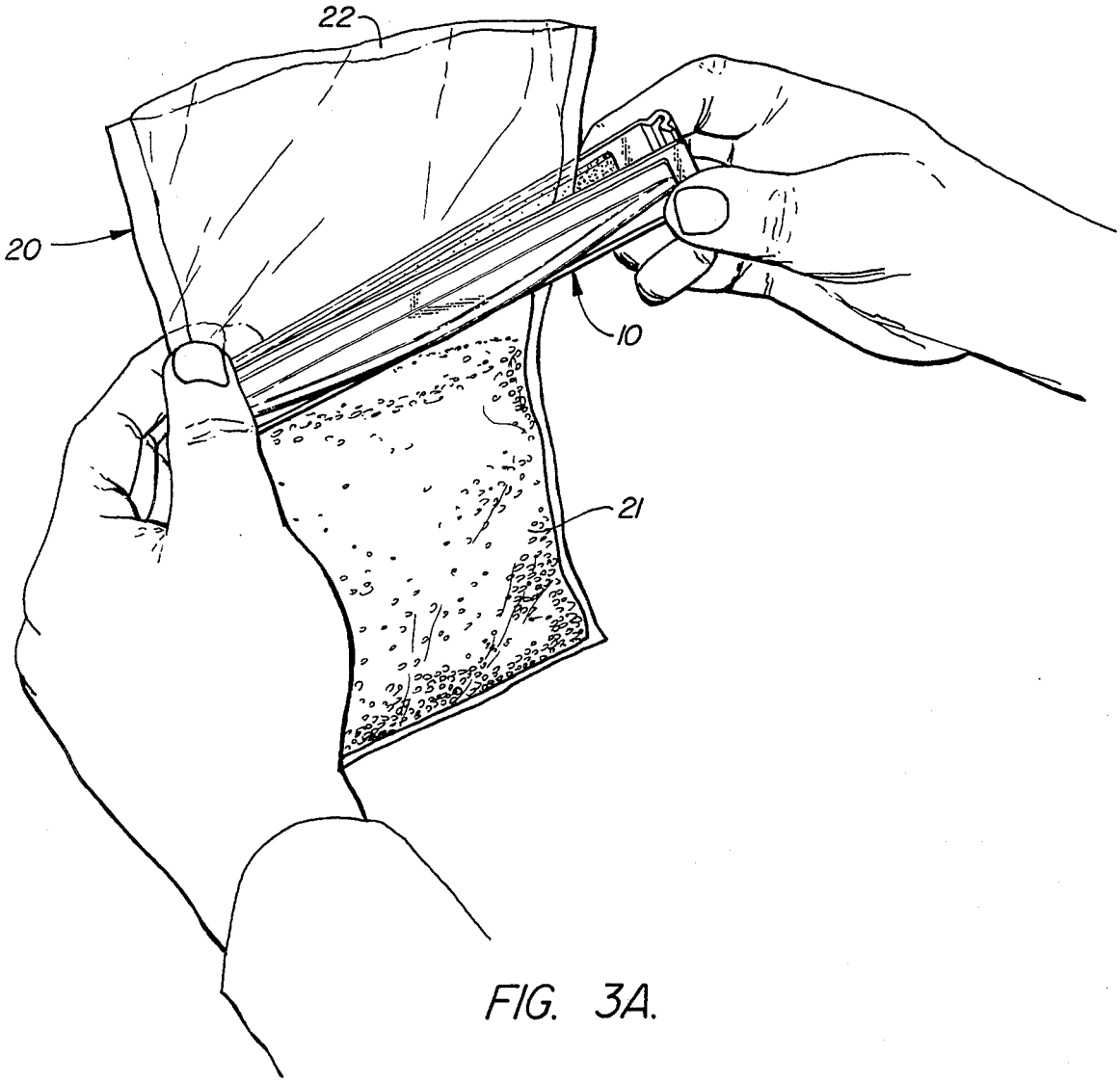
FIG. 3*a* is a perspective of the clamp of FIG. 2*a* being fastened onto a bag prior to placing into a vacuum environment.

FIG. 3*a* illustrates the manner in which the clamp 10 is attached to a bag of vacuum-tight material, such as a plastic bag. Clamp 10 is shown as being placed over bag 20 containing food material 21 to loosely seal the opening 22 of said bag. The locking means 15 may then be pivoted into a closed position to hold the clamp shut.

Figure 3B:
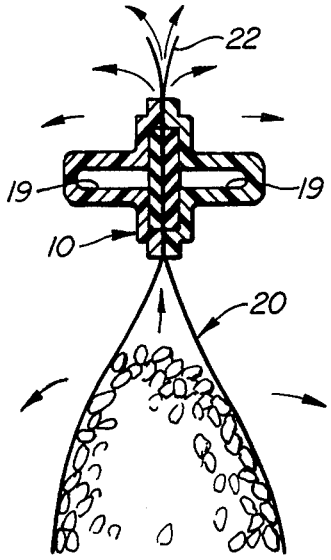
FIG. 3*b* is a cross section taken laterally through the clamp according to the instant invention and bag, while in a vacuum environment, wherein the arrows indicate the flow of air pressure towards the vacuum source.

FIG. 3*b* illustrates the air flow when the bag and clamp are exposed to a vacuum. Air is evacuated from the interior of the bag 20 through opening 22. The deformable sealing members 13 protrude slightly from prong surfaces to thereby prevent the solid prong surfaces from contacting the material of the plastic bag.

Figure 3C:
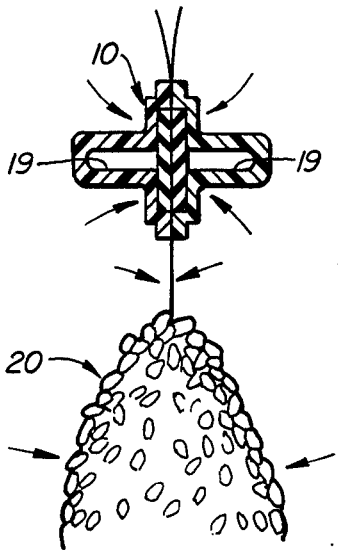
FIG. 3*c* is a cross section of the clamp and bag shown in FIG. 3*b*, with the vacuum having been released to atmospheric pressure.

Referring to FIG. 3*c* there is shown the bag and clamp when the vacuum is released to atmospheric pressure. In addition, the sudden onrush of atmospheric pressure onto the outer surfaces of the bag expels any remaining air from the bag, thereby resulting in a substantially perfect vacuum within the bag. When the vacuum is released rapidly, the pressure of atmospheric air collapses bag 20 whereas the sudden onrush of atmospheric pressure onto the outer surfaces of clamp 10 causes the prongs 11 to rapidly move together to compress and deform the porous deformable sealing members to tightly seal the bag 20 from the atmosphere. The bag may then be permanently sealed from the atmosphere by means of conventional heating device for heat-sealing plastic bags. The clamp may then be removed for reuse in another application.

Alternatively, the bag may be self-sealing dependent on the texture, thickness and cohesive properties of the bag material. Accordingly, the pressure exerted by the clamp on the bag may enable the bag to subsequently remain in a sealed condition, without any further requirement for separately sealing the bag.

Figure 4:
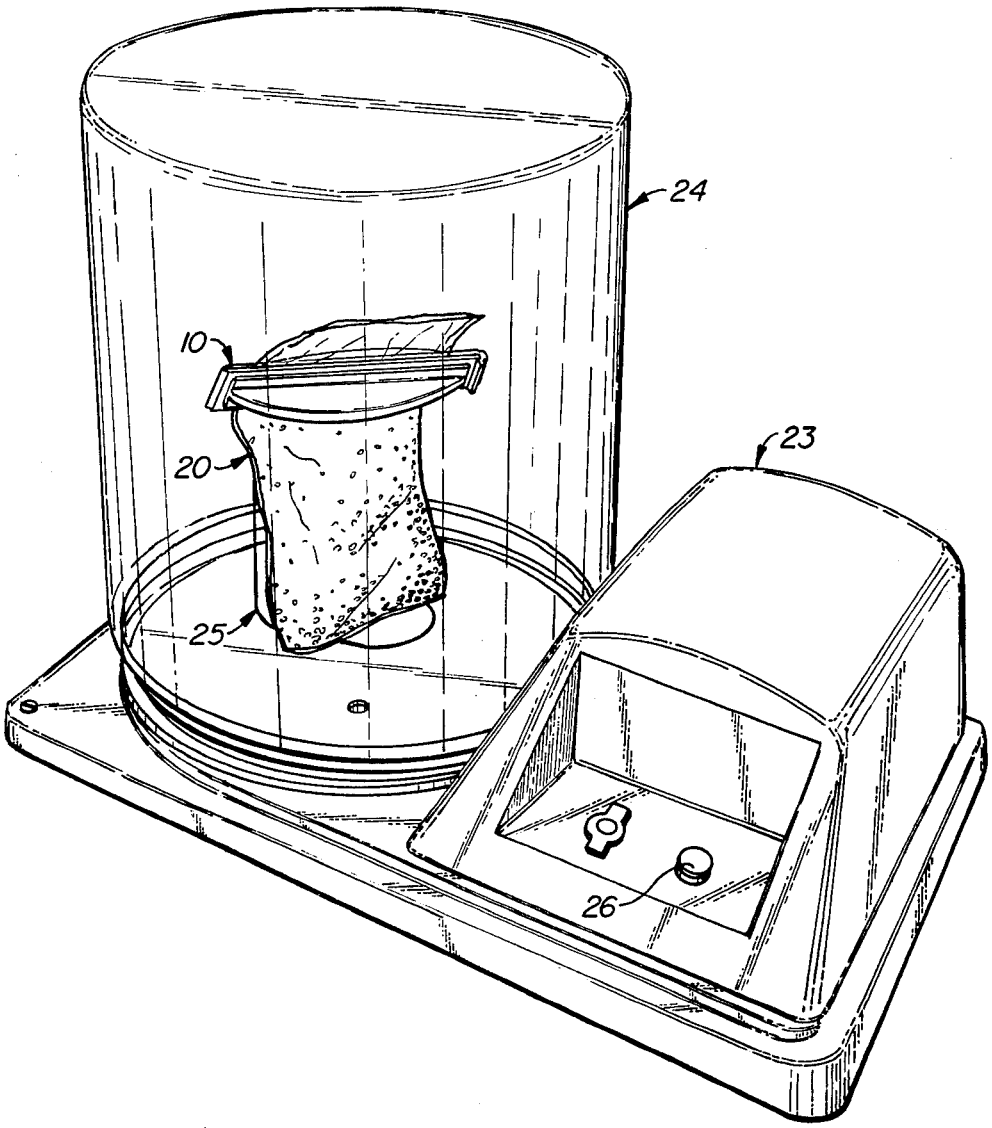
FIG. 4 is an overall perspective of a system of apparatus according to the invention, showing clamp means according to the instant invention attached to a bag containing food material within a sealable treatment zone.

Referring to FIG. 4 there is shown apparatus for subjecting bag 20 and clamp 10 to a vacuum. Preferably the bag 20 is placed in an upright position on stand 25 in bell chamber 24. The atmosphere in said chamber 24 is then evacuated by conventional vacuum pump means 23. The vacuum pump 23 may be equipped with a valve (not shown) to rapidly release the vacuum within the treatment zone, in this instance illustrated as a bell chamber 24. Such conventional vacuum pump may be of approximately ¼ horsepower and, in general, will be operated for a period of about 30 seconds to two minutes to draw a vacuum exceeding 40%. Viz., 100% being a perfect vacuum. It has been found that vacuums of approximately 70% may be generally achieved in approximately one minute. The vacuum within chamber 24 is released by a valve which is activated by depressing button 26. This vacuum release is normally accomplished within about 1 to 2 seconds.

Bag 20 may be constructed of a suitable gas-impermeable material, for example as in a conventional plastic bag, so as to remain securely closed and sealed with the clamp in place either permanently or at least for a period of time sufficient to allow the bag to be sealed by a conventional heat sealing apparatus. That is, the arrangement and function of the clamp means 10 should be such that the vacuum may be held by the clamp for a period of approximately 1 to 5 hours, which is more than a sufficient period to heat seal the plastic bag prior to releasing the clamp.

The clamp made according to the instant invention may be made of any suitable material, preferably plastic. The length of the prongs may be made to any convenient size to accommodate conventional plastic bags. The prongs may be fabricated to fit within the bell jar used in the vacuum system.

The invention provides a method and device for vacuum sealing vacuum-tight bags, such as plastic bags, which are convenient for home use. The method of the invention allows for vacuum sealing of food or perishable products within such bags of various sizes and shapes.

While in describing the invention, reference has been made above to particular embodiments of the same, it is to be understood that the invention is not limited to the construction shown in the accompanying and above described drawings, and that various changes may be made in the general arrangement of the device and the construction of its parts, without departing from the scope of the invention.

What is claimed is:

1. A system for vacuum packing perishable materials in open-ended bags constructed of gas-impermeable material, comprising a chamber of gas-impervious material, said chamber having an access opening of substantial dimension;

an open-ended bag of gas-impermeable material within said chamber, said bag being at least partially filled with a perishable material;

opposable clamp means adjacent to an open filling end of said bag and positioned exteriorly adjacent to said end of the bag on opposite sides thereof, said clamp means being positioned to hold said gas-impermeable material of said bags substantially flat in the area adjacent to said filling end; said clamp means being in the form of a plurality of flat, elongated prongs permanently adjoined at one end by hinge means, whereby at the unhinged end of a first prong a locking means is attached adapted to securely interlock with the unhinged end of a second prong, thereby holding said clamp means in a closed position;

an enclosure for said access opening of said chamber constructed of gas-impermeable material;

sealing means between said enclosure and said chamber;

means to evacuate the interior of said chamber, whereby gases may be withdrawn from the interior of said chamber and from within the interior of said bag and from within the interstices of said perishable materials;

means to break the vacuum within said chamber by rapidly introducing atmospheric air pressure into said chamber to thereby bring said opposable clamp means together to retain the vacuum within said bag, said clamp means being provided with deformable strip material upon opposable surfaces thereof, said deformable strip material serving to facilitate movement of gases from within said bag at such a time as the chamber is being evacuated but operable to quickly compress the gas impermeable material of said bag adjacent said filling end of the bag to retain said vacuum within said bag when said chamber is opened to atmospheric air pressure.

* * * * *